US011859401B2

(12) United States Patent
Pugno et al.

(10) Patent No.: US 11,859,401 B2
(45) Date of Patent: Jan. 2, 2024

(54) FENCE AND METHOD OF MANUFACTURING A FENCE

(71) Applicant: Charles G. Pugno, Bloomfield Hills, MI (US)

(72) Inventors: Charles G. Pugno, Bloomfield Hills, MI (US); Ronald J. Carnwath, Rochester Hills, MI (US); Melvin D. Herschberger, Nashville, MI (US)

(73) Assignee: Charles Pugno, Bloomfield Hills, MI (US)

( * ) Notice: Subject to any disclaimer, the term of this patent is extended or adjusted under 35 U.S.C. 154(b) by 224 days.

(21) Appl. No.: 17/547,522

(22) Filed: Dec. 10, 2021

(65) Prior Publication Data

US 2022/0186521 A1 Jun. 16, 2022

Related U.S. Application Data

(60) Provisional application No. 63/124,024, filed on Dec. 10, 2020.

(51) Int. Cl.
*E04H 17/16* (2006.01)

(52) U.S. Cl.
CPC ..... *E04H 17/166* (2013.01)

(58) Field of Classification Search
CPC ... E04H 17/16; E04H 17/1602; E04H 17/165; E04H 17/166; E04H 17/17; E04H 17/14; E04H 17/1413; E04H 17/1417; E04H 17/1426; E04H 17/143
See application file for complete search history.

(56) References Cited

U.S. PATENT DOCUMENTS 2,573,239 A * 10/1951 Barrett ..... E04H 17/1447 256/22
2,918,261 A * 12/1959 Bergeron ..... E04H 17/1465 D25/38.1
3,108,787 A * 10/1963 Case ..... E04H 17/1447 256/69
3,445,972 A 5/1969 Carr
4,114,860 A * 9/1978 Parisien ..... E04H 17/124 248/200

(Continued)

FOREIGN PATENT DOCUMENTS

DE 1709153 A1 * 7/1970
EP 0283371 A1 * 9/1988

(Continued)

*Primary Examiner* — Jonathan P Masinick
(74) *Attorney, Agent, or Firm* — Brooks Kushman P.C.

(57) ABSTRACT

A modular fence is disclosed that includes a metal frame that includes a top rail, a bottom rail, and a horizontally extending intermediate rail that are connected between upright vertical rails. The plastic planks are fixedly attached to an intermediate connector that is adapted to be assembled to the intermediate rail with fasteners. Top and bottom brackets are attached to the top and bottom rails. Top and bottom ends of the plastic planks are received in a gap or channel defined by the top and bottom brackets but are not fastened to the brackets. Alternatively, the top and bottom brackets may be attached to the ends of the plastic planks and the brackets may be assembled to the top and bottom rails with a gap defined between the brackets and the respective rails.

17 Claims, 6 Drawing Sheets

(56) References Cited

U.S. PATENT DOCUMENTS 4,477,058 A * 10/1984 Lowery ..... E04H 17/143 256/19
4,913,576 A 4/1990 Grant, Jr.
5,531,427 A * 7/1996 Quarles ..... E04H 17/143 256/22
5,702,090 A * 12/1997 Edgman ..... E04H 17/1426 256/65.02
6,152,428 A * 11/2000 Simioni ..... E04H 17/166 256/19
6,311,955 B1 * 11/2001 McGarry ..... E04H 17/1417 52/592.1
9,416,559 B2 8/2016 Brechon
10,787,838 B2 * 9/2020 Larsen ..... E04H 17/166
2002/0000545 A1 * 1/2002 Pettit ..... E04H 17/1439 256/19
2002/0125469 A1 * 9/2002 Jones ..... E04H 17/168 256/24
2003/0178613 A1 * 9/2003 Purvis ..... E04H 17/143 256/59
2005/0127345 A1 * 6/2005 Giacchino ..... E04H 17/1447 256/59
2006/0192190 A1 8/2006 Brucker
2010/0237308 A1 * 9/2010 Lo ..... E04H 17/1417 256/26
2011/0248231 A1 * 10/2011 Milner ..... E04H 17/165 256/65.03

FOREIGN PATENT DOCUMENTS

EP 3626913 A1 * 3/2020
FR 3041014 B3 * 10/2017
GB 2465084 A * 5/2010 ..... E04H 17/143
GB 2539764 A * 12/2016 ..... E04H 17/1413
GB 2570912 A * 8/2019 ..... E04H 17/14

* cited by examiner

FENCE AND METHOD OF MANUFACTURING A FENCE

CROSS REFERENCE TO RELATED APPLICATIONS

This application claims the benefit of U.S. provisional application Ser. No. 63/124,024 filed Dec. 10, 2020, the disclosure of which is hereby incorporated in its entirely by reference herein.

TECHNICAL FIELD

This disclosure relates to a panel fence and a method of manufacturing a panel fence.

BACKGROUND

Fences are well-known and may be made of wood, metal, chain link, barbed wire, plastic, or many other materials. A fence must be durable and weather resistant to withstand exposure to the elements and a wide range of temperatures. Mixing materials in the construction of a fence can lead to problems due to differences in the thermal expansion properties of the materials.

Steel fences offer excellent durability but are subject to corrosion, require painting, and are extremely heavy. Aluminum fences are durable and have less weight but may be easily dented if impacted especially if the face of the fence is damaged. Plastic fences are less durable and require reinforcements to stabilize the fence structure.

This disclosure is directed to solving the above problems and other problems as summarized below.

SUMMARY

A fence is disclosed that includes a metal frame and a modular fence panel made up of a plurality of plastic planks (hereinafter "plastic planks" or "planks"). The frame is erected in the field and the modular fence panel is subsequently attached to the frame. An intermediate bar is attached to the planks in the middle or at another location spaced from the top and bottom ends of the planks.

The plastic planks have a higher coefficient of thermal expansion than the metal frame and, as a result, the plastic planks expand and contract at a greater rate compared to the metal frame. Thermal expansion gaps are provided to accommodate the difference in the coefficient of thermal expansion of the planks relative to the frame. To accommodate the differences in thermal expansion, a gap is defined between the bracket and either the top and bottom rails or between the brackets and the top and bottom ends of the planks.

A combination fence is disclosed that includes a metal frame having a top rail, a bottom rail, and a horizontally extending intermediate rail. The top, bottom, and intermediate horizontal rails are connected between upright vertical rails with the intermediate rail being spaced from the top and bottom rails. The planks are fixedly attached to an intermediate bar that is adapted to be assembled to the intermediate rail with fasteners.

Top and bottom brackets are attached to the top and bottom rails. Top and bottom ends of the plastic planks are received in a gap or channel defined by the top and bottom brackets but are not fastened to the brackets. Alternatively, the top and bottom brackets may be attached to the ends of the plastic planks and the brackets may be assembled to the top and bottom rails with a gap defined between the brackets and the respective rails.

According to another aspect of this disclosure, a fence is disclosed that comprises a frame including a top rail, a bottom rail, an intermediate rail, a right-side rail and a left-side rail connected in a rectilinear array. A modular fence panel includes a plurality of planks having a front side and a rear side aligned in a plane adjacent to each other. The planks each a have a top end and a bottom end. The intermediate bar is fastened at an intermediate location on each of the planks. An intermediate bar is connected to and extends horizontally between the right-side rail and the left-side rail and is fastened to the intermediate rail. A top bracket is attached to the planks that includes a top channel adapted to receive the top end of the planks and the top rail in a downwardly facing opening. A top gap is defined between the top rail and a top wall of the top channel. A bottom bracket is attached to the planks and includes a first pocket defining an upwardly facing, opening that receives the bottom ends of the planks and a second pocket defining a downwardly facing opening that receives the bottom rail with a bottom gap being defined between the bottom rail and a base wall of the second pocket.

According to alternative aspects of this disclosure, the intermediate bar may be an L-shaped bar attached to the planks at the intermediate location, wherein the L-shaped bar is adapted to be attached to the intermediate rail. The L-shaped bars are adapted to be attached to the top and bottom rails with a fastener that is received in clearance openings in the top and bottom bars that permit the top and bottom bars to shift vertically as the planks expand and contract due to thermal expansion.

The fence panel is attached to the frame as a fully assembled module with the intermediate bar being attached to the intermediate rail that is attached to the right-side rail and the left-side rail. The top bracket is adapted to be hooked over the top rail, and the bottom bracket is adapted to be hooked over the bottom rail.

According to another aspect of this disclosure, a fence is disclosed that includes a frame and a modular fence panel. The frame is a rectilinear frame including a top rail, a bottom rail, an intermediate rail, a right-side rail and a left-side rail. The modular fence panel includes a plurality of planks having a front side and a rear side aligned in a plane adjacent to each other. The planks each a have a top end and a bottom end. An intermediate bar extends horizontally between the right-side rail and the left-side rail at an intermediate location on each of the planks. A top angle bar is attached to the planks and the top rail with fasteners that are received in holes defined by the top angle bar with a clearance between the fasteners and the hole defined by the angle bar. A top gap is defined between the top angle bar and the top rail that is sufficient to accommodate expansion and contraction of the planks between the intermediate location and the top rail. A bottom angle bar is attached to the planks and the bottom rail with fasteners that are received in holes defined by the bottom angle bar with a clearance between the fasteners and the hole defined by the bottom angle bar. A lower gap is defined between the bottom angle and the bottom rail sufficient to accommodate expansion and contraction of the planks between the intermediate location and the bottom rail.

According to another aspect of this disclosure, a method of manufacturing a fence is disclosed in which a module is attached to a frame built on-site. The method of manufacturing a fence comprises assembling the module by fastening plural planks having top ends and bottom ends to an intermediate rail at an intermediate location on the planks with the planks being oriented adjacent and parallel to each other. Top, intermediate, and bottom angle bars are attached proximate the top, intermediate and bottom portion of the planks. The intermediate bar is fixedly attached to the intermediate rail. The top and bottom angle bars are loosely attached with fasteners to the top and bottom rails with a gap between the bars and rails and with a clearance being defined between the fasteners and holes defined in the top and bottom angle bars.

The above aspects of this disclosure and other aspects will be described below with reference to the attached drawings.

BRIEF DESCRIPTION OF THE DRAWINGS

FIG. 1.1 is a cross-sectional view taken along the line 11-11 in FIG. 10.

DETAILED DESCRIPTION

Figure 1:
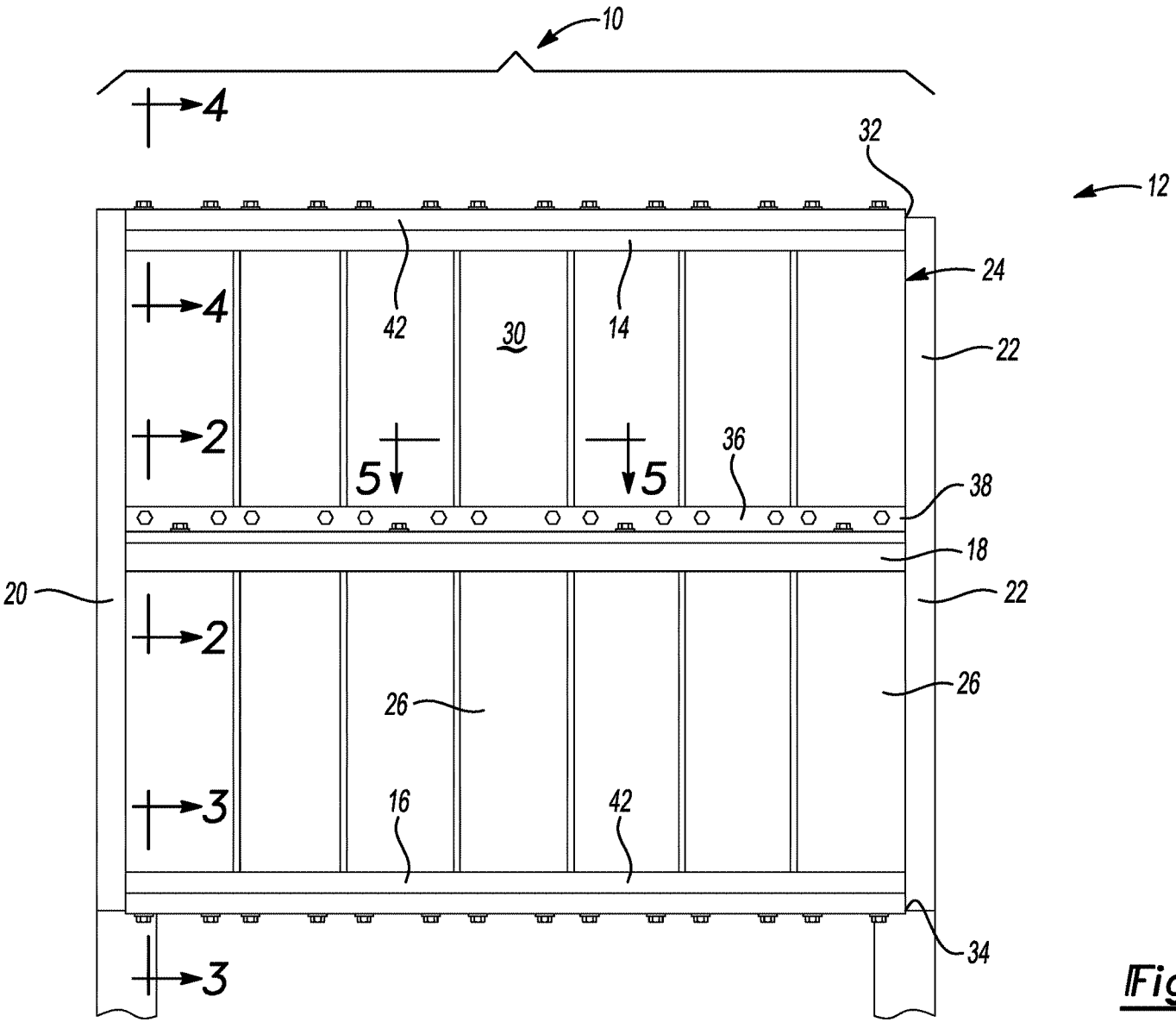
FIG. 1 is an exploded rear elevation view of a fence made according to one embodiment of this disclosure.

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Referring to FIGS. 1-4, a fence 10 is disclosed, that includes a frame 12 that is erected on-site by assembling a top rail 14, a bottom rail 16, and intermediate rail 18, a right-side rail 20, and a left-side rail 22. The rails 14-22 are either welded or assembled with fasteners and are made of metal such as steel or aluminum. The intermediate rail 18 is parallel to, and spaced from the top rail 14 and the bottom rail 16. The intermediate rail 18 extends horizontally and is attached to the right-side rail 20 and the left-side rail 22.

A modular fence panel 24 is pre-assembled off-site iii a manufacturing facility that includes a plurality of plastic planks 26 (planks). The planks 26 have a front side 28 and a rear side 30 that are assembled in a planar arrangement. The planks 26 have top ends 32 and bottom ends 34 that are aligned when the planks are assembled.

Figure 2:
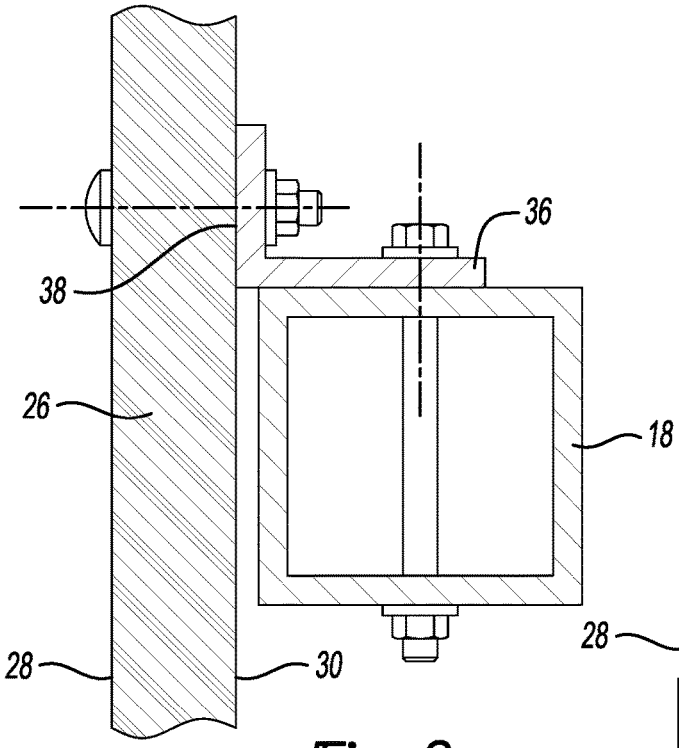
FIG. 2 is a cross-sectional view taken along the line 2-2 in FIG. 1.
Figure 9:
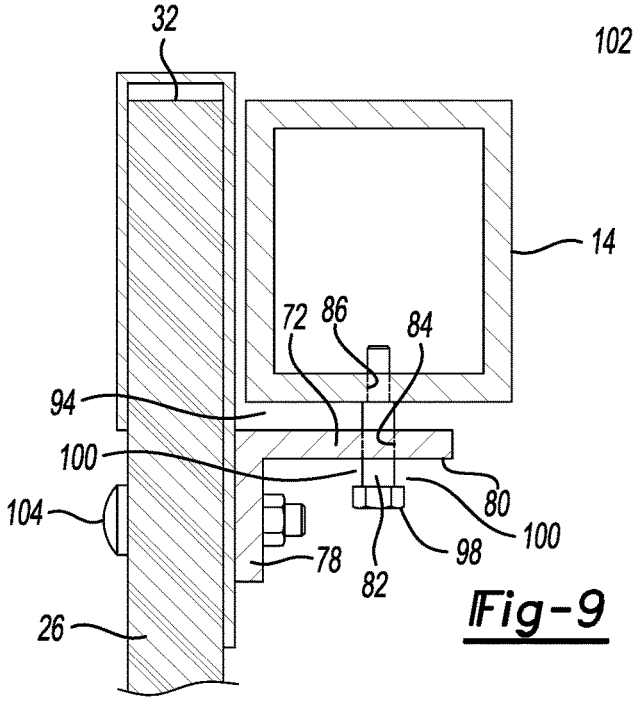
FIG. 9 is a cross-sectional view taken along the line 9-9 in FIG. 6.
Figure 10:
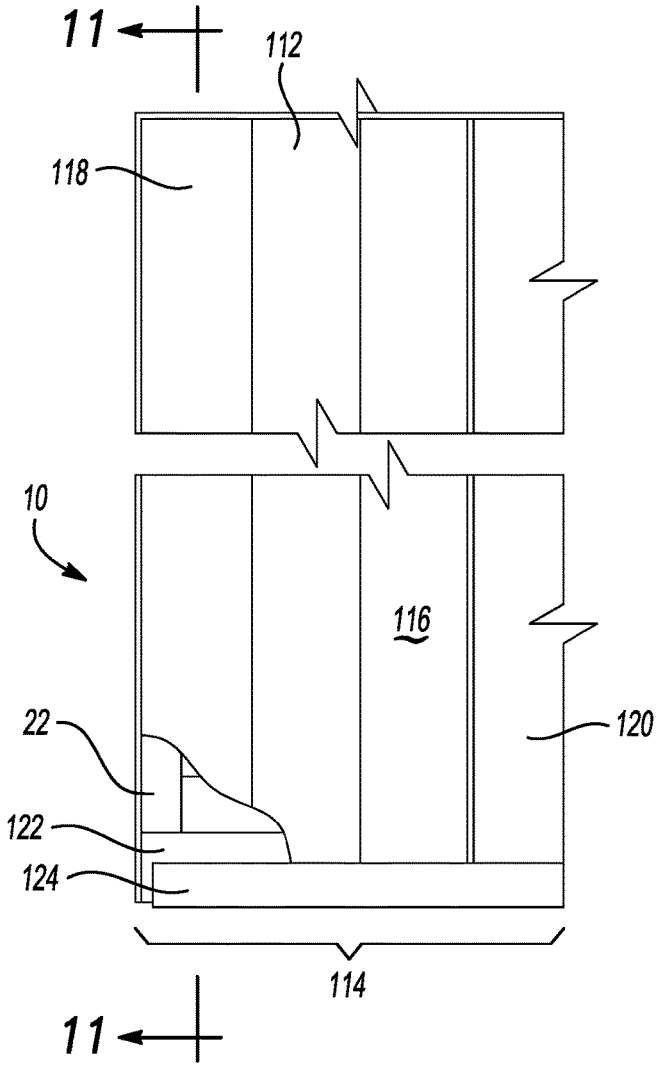
FIG. 10 is a front elevation view of an alternative embodiment of a fence.

With particular reference to FIG. 2, an intermediate bar 36 is an L-shaped angle bar that is assembled at an intermediate location 38 on the planks with fasteners. The intermediate bar 36 holds the planks 26 together (other reinforcements or supports, such as the top angle bar 72 and the bottom angle bar 74, may be used to hold the modular fence panel together, or alternatively a transverse connector may be provided as shown in FIGS. 9 & 10, to form the modular fence panel 24 that is transported to the site as a modular fence panel 24. The modular fence panel 24 is then assembled to the frame 12 by attaching the intermediate bar 36 to the intermediate rail 18 with fasteners.

Figure 3:
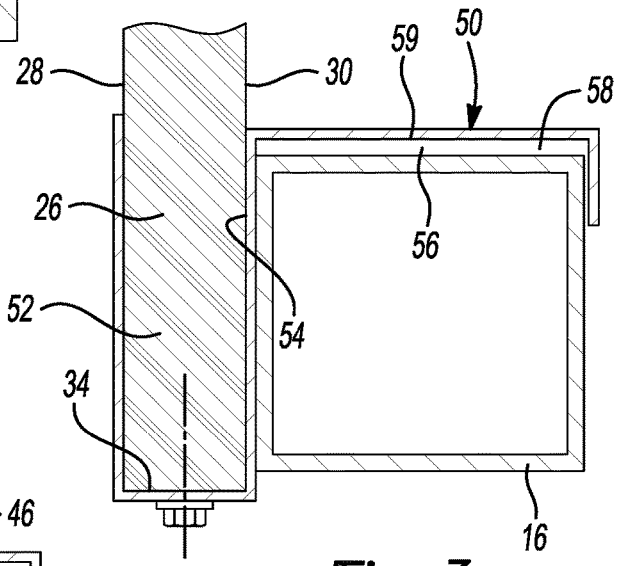
FIG. 3 is a cross-sectional view taken along the line 3-3 in FIG. 1.
Figure 4:
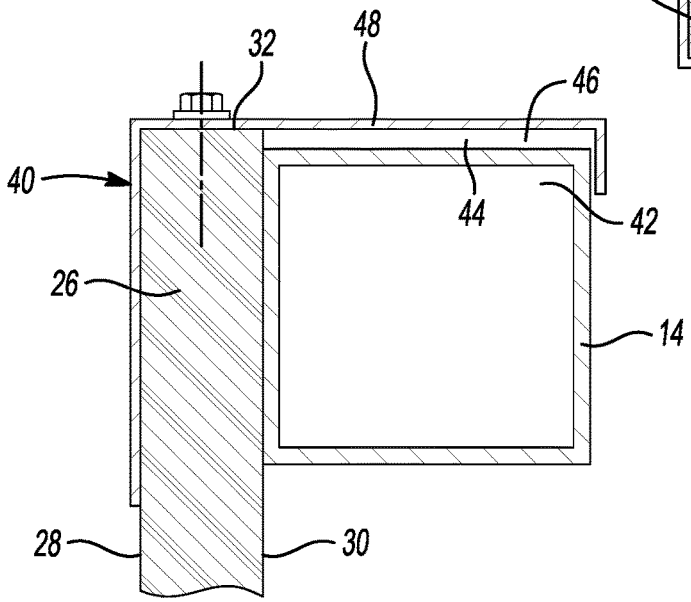
FIG. 4 is a cross-sectional view taken along the line 4-4 in FIG. 1.

With particular reference to FIG. 4, a top bracket 40 defines a channel 42 that is adapted to receive both the top rail 14 and the top end 28 of the planks 26. In the embodiment of FIGS. 1-4, the channel 42 has a downwardly facing pocket 44 and is attached to the top end 32 of the planks 26. The top bracket 40 is attached to the planks 26 with fasteners. A top gap 46 is defined between a top wall 48 of the top bracket 40 and the top rail 14. The spacing between the intermediate bar 36 and the top bracket 40 sets the gap 44 to allow for expansion and contraction of the upper portion of the planks 26.

With particular reference to FIG. 3, a bottom bracket 50 defines a bottom channel 52 that defines an upwardly facing pocket 54 that is adapted to receive the bottom ends 34 of the planks 26. The bottom ends 34 of the planks 26 are fastened to the upwardly facing pocket 54 of the bottom bracket 50. The bottom bracket 50 also includes a downwardly facing pocket 56 that is hooked over the bottom rail 16 with a bottom gap 58 being defined between the bottom rail 16 and a base wall 59 of the downwardly facing pocket 56. The spacing between the intermediate bar 36 and the bottom bracket 50 establishes the bottom gap 5$ that accommodates expansion and contraction of the lower portion of the planks 26.

Figure 5:
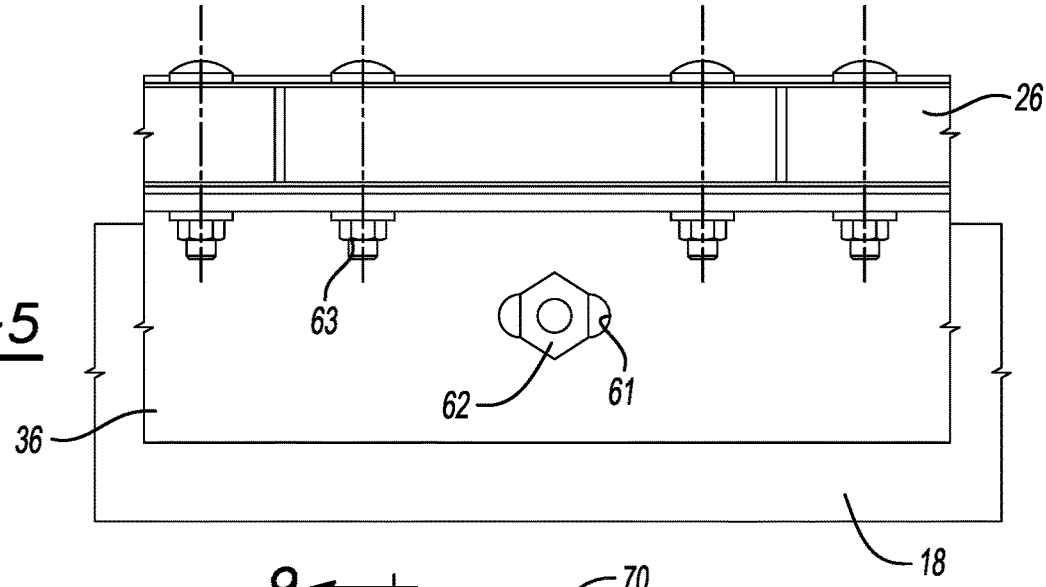
FIG. 5 is a fragmentary top plan view of a portion of the intermediate bar attached to the intermediate rail.
Figure 6:
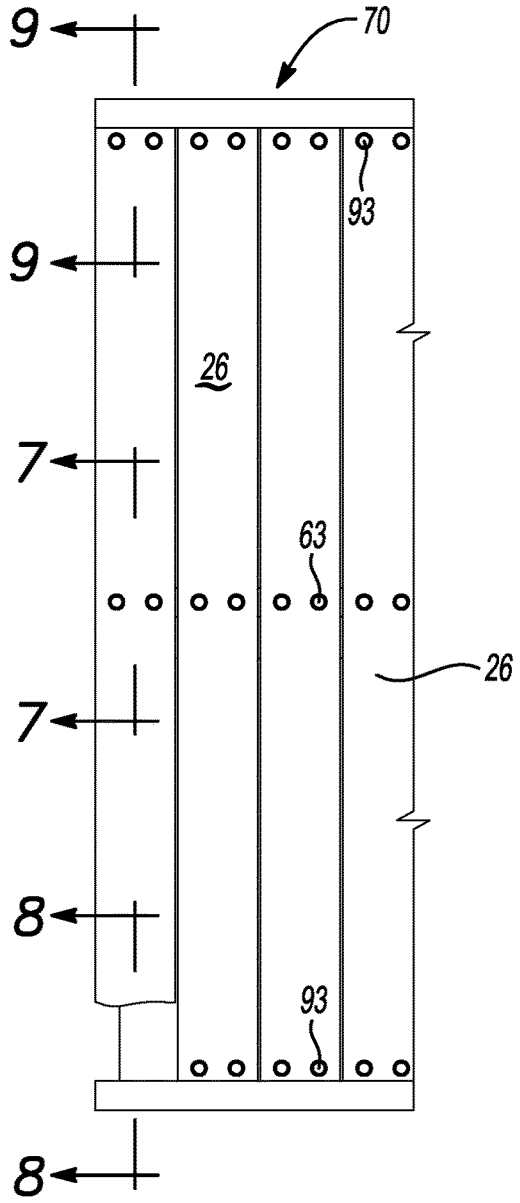
FIG. 6 is a fragmentary front elevation view of a fence made according to another embodiment of this disclosure.

Referring to FIG. 5, a fragmentary top plan view of a portion of the intermediate rail 18 and the intermediate bar 36 is provided to show how the intermediate bar 36 is fastened to the intermediate rail 18. A slot 61 is provided on the intermediate bar 36 that receives fasteners 62 (e.g., carriage bolts). The slot 61 provides relief for positioning the intermediate bar 36 laterally on the intermediate rail 18. The planks 26 are fastened to the intermediate bar 36 by fasteners 63 to secure the planks on the intermediate bar 36.

Referring to FIGS. 6-9 another embodiment of the fence 70 is illustrated that differs from the embodiment, of FIGS. 1-4 in that a top angle bar 72 is attached to the top rail 14, a bottom angle bar 74 is attached to the bottom rail 16. and an intermediate angle bar 76 is attached to the intermediate rail 18. The angle bars have two w all: that meet at a 90-degree angle. A vertical wall 78 is attached flush to the planks 26 and a horizontal wall 80 extends perpendicularly from the back side 30 of the planks 26.

The top angle bar 72 is attached with shoulder screws 82 to the top rail 14 with clearance between the shoulder screws 82 and an opening 84 defined by horizontal wall 80 of the top angle bar 72. The bottom angle bar 74 is attached with shoulder screws 82 to the bottom rail 16 with clearance between the shoulder screws 82 and an opening 86 defined by the horizontal wall 80. The clearances are provided to accommodate thermal expansion of the planks 26 by allowing the upper and lower angle bars to move in a vertical direction relative to the length of the shoulder screws 82 through the openings 84 and 86. The shoulder screws 82 are fixedly attached to the rail 14 and the L-shaped bars are allowed to move vertically due to thermal expansion and contraction. The angle bar 72 has clearance slots or holes where they receive the shoulder screws 82. Shoulder screws 82 are preferred because access to the tip of the shoulder screws is difficult inside the rails.

Figure 7:
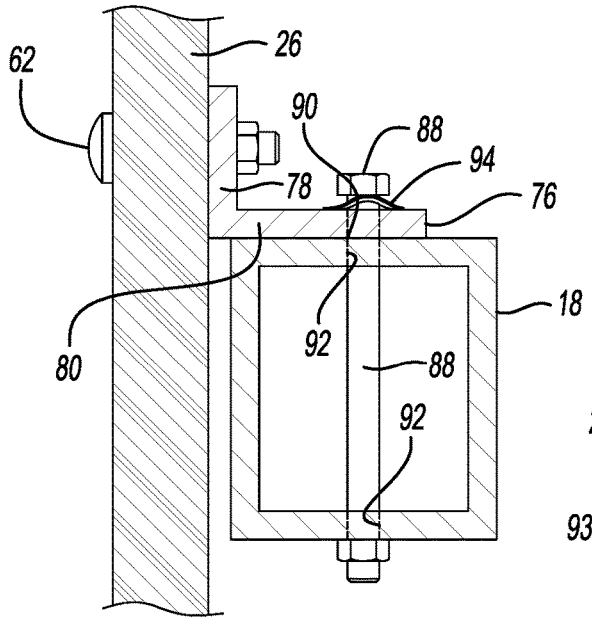
FIG. 7 is a cross-sectional view taken along the line 7-7 in FIG. 6.

Referring to FIG. 7, one of the planks 26 is shown o be attached to the intermediate angle bar 76 by fasteners 62.

The horizontal wall 80 of the intermediate angle bar 76 is fixedly attached with a carriage bolt 88 to the intermediate rail 18 with the carriage bolt 88 being received in a hole 90 defined by the horizontal wall 80 and in a hole 92 defined by the top wall and bottom wall of the intermediate rail 18. The carriage bolt 88 extends completely through and is fastened with a nut to fixedly attach the intermediate angle bar 76 to the intermediate rail 18.

Figure 8:
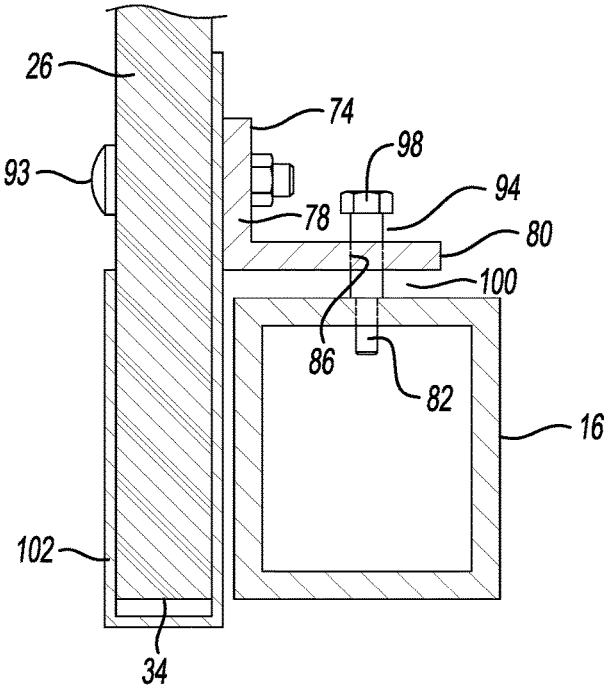
FIG. 8 is a cross-sectional view taken along the line 8-8 in FIG. 6.

Referring to FIG. 8, one of the planks 26 is shown to be attached to the bottom angle bar 74 by fasteners 93. The horizontal wall 80 of the bottom angle bar 74 is retained on the bottom rail 16 with the shoulder screws 82 being received in the opening 86 defined by the bottom angle bar 74 and screwed into bottom rail 16. A clearance 100 is defined between the shoulder screws 82 and the opening 86 that is a sufficient clearance to allow the angle bar 74 to be raised and lowered by thermal expansion of the planks 26. (e.g., 2.0 to 3.0 mm.) The shoulder screws 82 are attached to the bottom rail 16 with an upper gap 94 defined between the head 98 of the shoulder screw 82 and the horizontal wall 80 and a lower gap 100 being defined between the horizontal wall 80 and the bottom rail 16. As the planks 26 expand or contract in the vertical direction, the bottom ends 34 of the planks and angle bar 74 can move vertically relative to the bottom rail 16. A bottom trim piece 102 is attached to the bottom end of the planks 26. The trim piece 102 may be assembled between the bottom angle bar 74 and the plank 26 and is held in place by the fasteners 93.

Referring to FIG. 9, one of the planks 26 is shown to be attached to the top angle bar 72 by fasteners 104. The horizontal wall 80 of the top angle bar 72 is retained on the top rail 14 with the shoulder screws 82 being received in the opening 84 defined by the top angle bar 72. The shoulder screws 82 are screwed into the top rail 14. A clearance is defined between the shoulder screws 82 and the opening 84 that is a sufficient clearance to allow the top angle bar 72 to be raised and lowered by thermal expansion of the planks 26, (e.g., 2 to 3 mm.) The shoulder screws 82 are attached to the top rail 14 with an upper gap 94 defined, between the horizontal wall 80 and the bottom rail 16. A lower gap 100 is defined between the head 98 of the shoulder screw 82 and the horizontal wall 80. As the planks 26 expand and contract in, the vertical direction, the top end of the planks 26 can move vertically relative to the bottom rail 16.

The fence includes a frame that is substantially the same as the frame described with reference to FIGS. 1-9 that includes the frame 12 that is pre-assembled by assembling a top rail 14, a bottom rail 16. and intermediate rail 18, a right-side rail 20, and a left-side rail 22. The rails 14-22 are preferably welded but may be assembled with fasteners. The frame rails are, made of metal, such as steel or aluminum. The intermediate rail 18 is parallel to, and spaced from the top rail 14 and the bottom rail 16. The intermediate rail 18 extends horizontally and is attached to the right-side rail 20 and the left-side rail 22. The right-side rail 20 and left-side rail 22 may include portions that extend below the bottom rail 16 thereby raising the height of the fence. The portions extending below the bottom rail 16 may be provided with escutcheons to facilitate attaching the fence 110 to a concrete mounting surface or may be embedded in the ground or other foundation.

Referring to FIG. 10, an alternative embodiment of a fence 110 is illustrated that is made up of plastic planks 112 that are assembled in modules 114 of 3 or 4 planks but could be modules including 5 or more planks 112. Though not preferred, the fence could be made up of single planks 112. The planks 112 as illustrated are viewed in FIG. 10 showing their front side 116. The planks each have a top end 118 and a bottom end 120. The bottom ends 120 of the planks 112 are attached to the bottom transverse connector 122.

A bottom L-shaped trim piece 124 is shown, in part, that is attached to the bottom rail 16. The bottom L-shaped trim piece 124 covers the bottom ends 120 of the planks 112. The bottom ends 120 of the planks 112 are free to move relative to the trim pieces 124 and the bottom rail 16 to accommodate expansion and contraction of the planks 112. As illustrated in FIG. 10, the bottom of the left side plank 112 and the L-shaped trim piece are fragged away to better show the bottom transverse connector 122 in relation to the bottom rail 16

Figure 11:
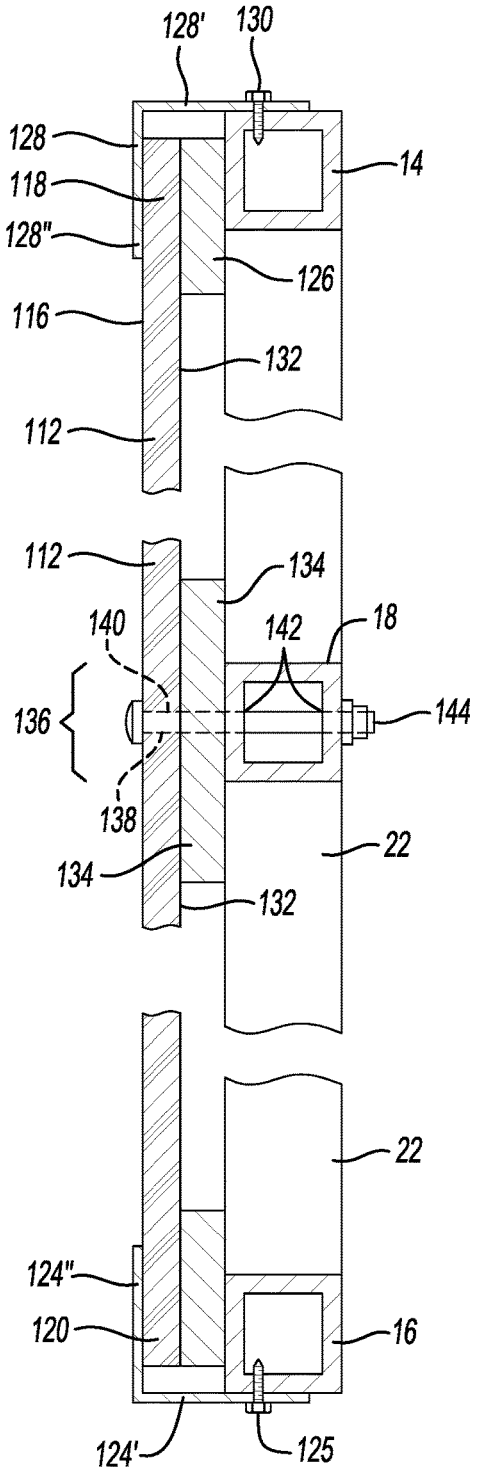
Figure 12:
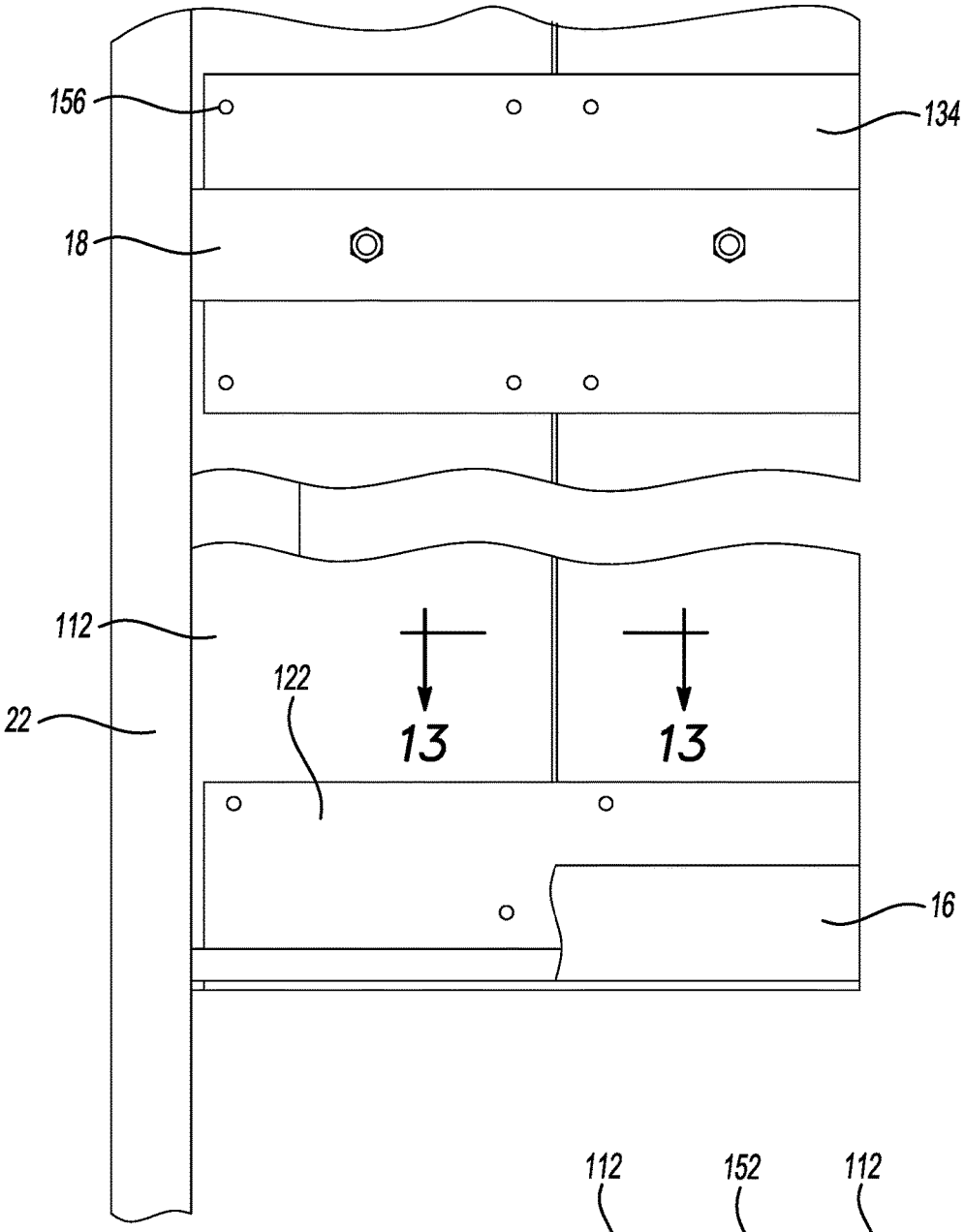
FIG. 12 is a rear elevation view, partially fragmented, of the fence shown in FIG. 10.

Referring to FIG. 11, the bottom L-shaped trim piece 124 is attached to the bottom rail 16 with fasteners 125. The bottom L-shaped trim pieces 124 include a horizontal leg 124' that is attached to a bottom surface of the bottom rail and a vertical leg 124" that extends in front of the front side 116 of the planks 112. The horizontal leg 124' the vertical leg 124" are joined at a slight angle of about 87° to 89° in the free state to apply a lateral load to the front side 116 of the planks 112 near the bottom ends 120. A top transverse connector 126 is attached to the top end 118 of the planks to assemble the top end of the module 114 that includes several planks.

A top L-shaped trim piece is attached to the top rail 14 preferably on a top surface thereof with a fastener 130. The top L-shaped trim piece 128 is attached to the top rail 14 with fasteners 130. The top L-shaped trim pieces 128 include a horizontal leg 128' that is attached to a top surface of the top rail 14 and a vertical leg 128" that extends in front of the front side 116 of the planks 112. The horizontal lee 128' the vertical leg 128" are joined at a slight angle of about 87' to 89° in the free state to apply a lateral load to the front side 116 of the planks 112 near the top ends 118.

The trim piece is preferably assembled off-site when the frame 12 is assembled to minimize assembly operations in the field where the fence 110 is to be erected. In FIG. 11 the back side 132 of the planks 112 is shown in relation to the top transverse connector 126. The top ends of the planks 118. and the top L-shaped trim piece 128.

The top transverse connector 126 and the bottom transverse connector 122 in addition to connecting the planks 112 together to form the modules 114 also function as spacers that space the top ends 118 and bottom ends 120 from the frame 12.

An intermediate transverse connector 134 is attached at an intermediate location 136 on the planks on the planks 112 at the same level as the intermediate rail 18. The planks 112 define a hole 138 that is aligned with a hole 140 defined by the intermediate transverse connector 134. A pair of holes 142 are defined in the spaced walls of the intermediate rail 18. A nut and bolt 144 is assembled through the holes 138, 140, and 142 and secured with a nut that is tightened to securely fasten the planks 112 to the intermediate transverse connector, and the intermediate bar.

As described with reference to FIG. 10 and as also shown in FIG. 11, the bottom ends of the planks 112 are connected by the bottom transverse connector 122 to form the modules 114. The modules 114 can be transported with the frame 12 and the desired number of modules 114 to the site where the fence is to be installed with the frame 12 preassembled. The modules 114 are longer than the space between the top L-shaped trim piece 128 and the bottom L-shaped trim piece but shorter than the space between the horizontal leg 124' of the bottom L-shaped trim piece and the horizontal leg 128' of the L-shaped trim piece 128. To assemble the modules 114 to the frame 12, the modules are bent lengthwise to clear the vertical, legs 124" and 128" and are received between the vertical legs and the frame 12. The bolt 144 is inserted through the holes 138, 140, and 142 and secured with the nut to secure the modules 114 to the frame 12. A top gap 146 is defined between the top end 118 of the planks 112 and the horizontal leg 128 of the L-shaped trim piece 128. A bottom gap 148 is defined between the bottom end 120 of the planks 112 and the horizontal leg 124' of the L-shaped trim piece 124.

Figure 13:
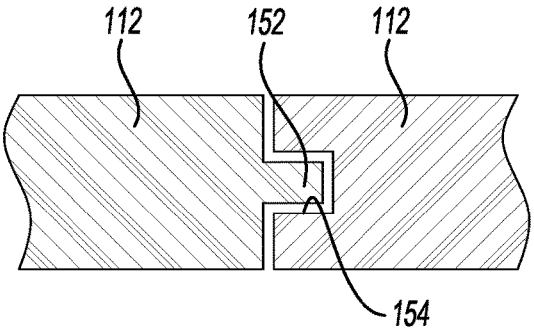
FIG. 13 is a cross-sectional view taken along the line 13-13 in FIG. 12.

Referring to FIG. 13. the planks are shown to be of the tongue 152 and groove 154 type. The vertical edges of the planks 112 are fit together with the tongues 152 being inserted in the grooves 154 to eliminate any gaps between the planks 112.

The embodiments described above are specific examples that do not describe all possible forms of the disclosure. The features of the illustrated embodiments may be combined to form further embodiments of the disclosed concepts. The words used in the specification are words of description rather than limitation. The scope of this disclosure is broader than the specifically disclosed embodiments and also includes modifications of the illustrated embodiments.

We claim:

1. A fence comprising:

a frame including a top rail, a bottom rail, an intermediate rail, a right-side rail and a left-side rail connected in a rectilinear array; and a modular fence panel including a plurality of planks having a front side and a rear side aligned in a plane adjacent to each other, the planks each having a top end, and a bottom end, an intermediate bar extends horizontally between the right-side rail and the left-side rail, the intermediate bar is fastened at an intermediate location on each of the planks, and the intermediate bar is fastened to the intermediate rail, wherein the top ends overlie and are free to move relative to the top rail, and the bottom ends overlie and are tree to move relative to the bottom rail, wherein at least one top transverse connector secures the planks together at a location spaced above the intermediate bar, and wherein at least one bottom transverse connector secures the planks together at a location spaced below the intermediate bar.

2. The fence of claim 1 wherein the intermediate bar is disposed between the plurality of planks and the intermediate rail spacing the planks from the intermediate rail, and wherein the intermediate bar is connected to the plurality of planks and secures the plurality of planks together.

3. The fence of claim 2 where in the intermediate bar is fastened at the intermediate location on each of the planks to the intermediate rail with a bolt that extends through one of the planks, the intermediate bar, and the intermediate tail.

4. The fence of claim 1 wherein the top transverse connector is disposed between the top end of the planks and the top rail, and the top transverse connector is secured to the top end of the planks.

5. The fence of claim 1 wherein the bottom transverse connector is disposed between the bottom end of the planks and the bottom rail, and the bottom transverse connector is secured to the bottom end of the planks.

6. The fence of claim 1 wherein the intermediate bar is disposed between the plurality of planks and the intermediate rail, and wherein the intermediate bar is connected to the planks and secures the planks together, wherein the top transverse connector is disposed between the top end of the planks and the top rail, and wherein the top transverse connector is secured to the top end of the planks, and wherein the bottom transverse connector is disposed between the bottom end of the planks and the top rail, and wherein the bottom transverse connector is secured to the bottom end of the planks.

7. The fence of claim 1 wherein the planks each include a tongue on one lateral side and a groove on a second lateral side, and wherein the tongue of one of the planks is received in the groove of an adjacent one of the planks.

8. The fence of claim 1 further comprising:

a top L-shaped trim piece having a first horizontally extending leg attached to the top rail and a second horizontally extending leg extending downwardly and partially over an outer side of the plurality of planks, and a bottom L-shaped trim piece having a third horizontally extending leg attached to the bottom rail and a fourth horizontally extending leg extending upwardly and partially over the outer side of the plurality of planks.

9. The fence of claim 8 wherein a top expansion space is provided between the top end of the planks and the first horizontally extending leg of the top L-shaped trim piece, and wherein a bottom expansion space is provided between the bottom end of the planks and the third horizontally extending leg of the bottom L-shaped trim piece.

10. The fence of claim 1 further comprising:

a top bracket attached to each of the planks, the top bracket including a top channel adapted to receive the top end of the planks in a downwardly facing opening, and wherein a gap is defined between the top rail and a top wall of the top channel; and a bottom bracket attached to each of the planks, the bottom bracket including a first pocket defining an upwardly opening pocket that receives the bottom ends of the planks and a second pocket defining a downwardly opening pocket that receives the bottom rail with a gap being defined between the bottom rail and an upper wall of the second pocket.

11. The fence of claim 1 wherein the intermediate bar is an L-shaped bar attached to the planks at the intermediate location, wherein the L-shaped bar is adapted to be attached to the intermediate rail.

12. The fence of claim 1 comprising:

an intermediate spacer plate attached to the planks between each of the planks and the intermediate rail;

a top spacer plate attached to the planks between each of the planks and the top rail; and a bottom spacer plate attached to the planks between each of the planks and the bottom rail.

13. The fence of claim 1 further comprising:

a bottom bracket that is hooked over the bottom rail; and a top bracket that is hooked over the top rail.

14. The fence of claim 1 further comprising:

a top bracket connected to at least one of the plurality of planks or the top rail with the top end of the planks being moveable relative to the top rail to accommodate thermal expansion of the planks; and a bottom bracket connected to at least one of the plurality of planks or the bottom rail with the bottom end of the planks being moveable relative to the bottom rail to accommodate thermal expansion of the planks, wherein the modular fence panel is attached to the frame as a fully assembled module with the intermediate bar being attached to the intermediate rail that extends between the right-side rail and the left-side rail, the top bracket being hooked over the top rail, and the bottom bracket being hooked over the bottom rail.

15. A method of manufacturing a fence comprising:

fastening plural planks to an intermediate bar at an intermediate location on the planks with the planks being oriented adjacent and parallel to each other to form a module;

fastening a top end of the planks to a top connector;

fastening a bottom end of the planks to a bottom connector;

building a rectilinear frame including an intermediate horizontal rail, a horizontal top rail, a horizontal bottom rail, a vertical left-side rail, and a vertical right-side rail, wherein the vertical left-side rail and the vertical right-side rail each include leg portions that are adapted to be secured to a ground surface; and assembling the module to the rectilinear frame by fastening the intermediate bar to the intermediate horizontal rail, aligning the bottom connector on the bottom ends of the planks with the horizontal bottom rail to be moveable relative to the bottom rail, and aligning the top connector on the top ends of the planks with the horizontal top rail to be moveable relative to the bottom rail.

16. The method of claim 15 further comprising:

attaching a bottom bracket to a lower surface of the horizontal bottom rail; and attaching a top bracket to an upper surface of the horizontal top rail, wherein the step of aligning the bottom connector with the horizontal bottom rail includes inserting the planks and the bottom connector into a bottom gap defined by the bottom bracket and the step of aligning the top connectors with the horizontal top rail includes inserting the planks and the top connector into a top gap defined by the top bracket.

17. The method of claim 16 wherein a bottom expansion space is defined between the bottom end of the planks and the bottom connector relative to the bottom bracket, and wherein a top expansion space is defined between the top end of the planks and the top connector relative to the top bracket.

* * * * *